United States Patent [19]

Westover et al.

[11] 3,991,965

[45] Nov. 16, 1976

[54] CHAIR HEIGHT ADJUSTING MECHANISM

[75] Inventors: Fred R. Westover, Canfield; Philip J. Williams, Youngstown, both of Ohio

[73] Assignee: GF Business Equipment, Inc., Youngstown, Ohio

[22] Filed: Jan. 27, 1976

[21] Appl. No.: 652,667

[52] U.S. Cl. ..... 248/406; 297/347

[51] Int. Cl.[2] ..... F16M 13/00; F16M 11/24; A47C 3/24

[58] Field of Search ..... 248/406, 405, 401; 108/136, 141, 142; 297/339, 349, 347

[56] References Cited

UNITED STATES PATENTS

| | | | |
|---|---|---|---|
| 2,702,075 | 2/1955 | Richards | 108/136 |
| 3,218,021 | 11/1965 | Michalshi | 248/401 |
| 3,799,486 | 3/1974 | Mohr | 248/406 |
| 3,870,270 | 3/1975 | Holtz | 248/406 |
| 3,870,271 | 3/1975 | Bowman | 248/406 |

*Primary Examiner*—J. Franklin Foss
*Attorney, Agent, or Firm*—Emory L. Groff, Jr.

[57] ABSTRACT

A chair seat support apparatus includes a base column internally housing means automatically operable only when the chair seat is unoccupied to allow vertical altering of the height of the seat upon rotation thereof. A screw post is journalled within the base column by means of vertically displaceable upper and lower bearings between which is disposed a notched adjustment nut carried by the screw post. Spring means, responsive to an unoccupied chair seat, urges the lower bearing upwardly which in turn vertically displaces the adjustment nut and its captive screw post. Stop means carried by the base column limits the vertical displacement of the adjustment nut and also precludes arcuate motion of the adjustment nut when elevated such that subsequent rotation of the chair seat and screw post produces vertical displacement thereof relative the base column and adjustment nut.

11 Claims, 6 Drawing Figures

CHAIR HEIGHT ADJUSTING MECHANISM

This invention relates generally to improved support means for a chair of the swivel or pivotal type, and more particularly, to a height adjusting mechanism for chairs wherein means are included to permit the automatic adjustment of the height by rotation of a chair seat when unoccupied and wherein the height adjusting mechanism becomes inoperative whenever the chair seat is occupied and subsequently swiveled.

Numerous mechanisms have been provided to enable a user to selectively adjust the height of a swivel chair. A spindle and nut combination has been employed in a majority of these past efforts for providing an adjustable swivel chair. In some instances this nut is permanently fixed relative the floor engaging portion of the chair base such that rotation of the chair seat and its spindle produces a raising or lowering of the spindle and chair seat. The disadvantages of such a construction are quite apparent since it follows that whenever the chair seat is swiveled, either intentionally or accidentally, and whether or not the chair seat is occupied, the height of the chair seat will be altered. Another arrangement has involved the use of a floating spindle nut wherein means are provided to preclude vertical displacement of a turning spindle, except when the user manually engages an extension of the nut and positively rotates the nut in order to lower or raise the spindle passing therethrough. The disadvantages of both of the above related forms of chair height adjustment mechanisms are quite obvious and it is the intention of the present invention to provide an improved arrangement wherein chair height alteration is readily achieved merely by rotating the chair seat when in the unoccupied condition and wherein the rotation of the chair seat when in the occupied condition fails to produce any change in the chair seat height. Such a type of operation has been employed in the past yet the instant arrangement involves an improvement including a simplified combination of components arranged in a far better manner than any such mechanism heretofore, with the result that a minimum vertical displacement of the chair seat takes place when an outside mass is removed from the seat and all swivel motions and adjustments proceed in an extremely smooth and quiet manner.

Accordingly, one of the primary objects of the present invention is to provide an improved chair height adjusting mechanism including a screw post carrying upper and lower bearings between which is disposed a lock nut.

Another object of the present invention is to provide an improved chair height adjusting mechanism including a base column containing a screw post having a lock nut and wherein the column includes stop means automatically arcuately immobilizing the lock nut when the chair is unoccupied.

A further object of the present invention is to provide an improved chair height adjusting mechanism including a base column containing a pair of vertically shiftable bearings having a lock nut disposed intermediately therebetween and having spring means normally urging the lowermost one of said bearings upwardly to direct the nut into engagement with fixed lock means when the chair is unoccupied to immobilize the lock nut against rotary displacement.

Still another object of the present invention is to provide an improved chair height adjusting mechanism including a screw post supported by two bearings disposed within a base column with a lock nut carried by the screw post between the bearings and including means allowing for the vertical displacement of the lower one of said bearings, both relative the base column and screw post.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawings.

Figure 4:
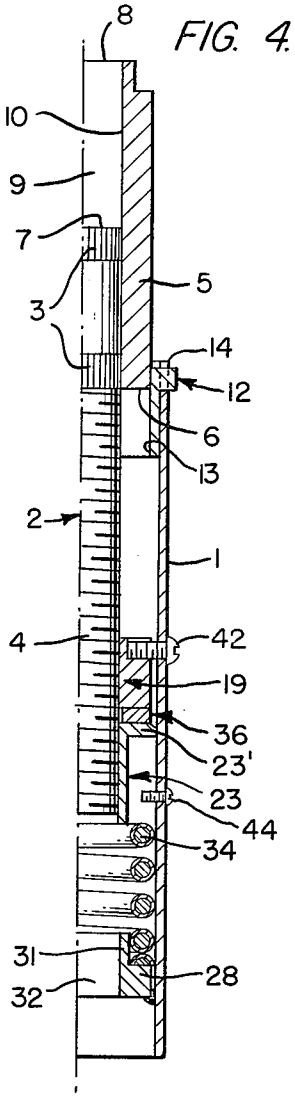
FIG. 4 is a fragmentary vertical sectional view of the structure shown in FIG. 3 as it appears when the seat is unoccupied.
Figure 3:
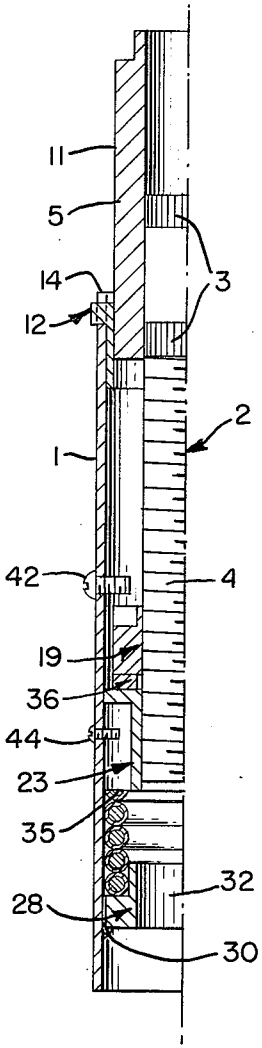
FIG. 3 is a fragmentary vertical sectional view illustrating the structure of the present invention as it appears when adjusted to the upper limit of its adjustment and the chair is occupied.

Referring now to the drawings, and particularly FIGS. 1–4, the present invention will be understood to comprise a plurality of slidably or threadedly interengaging components contained within a base or support column and which, together, comprise the principal portion of the understructure of a swivel or pivotal chair. Any suitable means such as a plurality of radiating legs, with or without casters thereon, may be attached to the lower portion of the illustrated structure to provide engaging means for contact with the floor, while on the otherhand, any suitable type of chair seat structure, with or without appropriate arms and/or back, are intended to be suitably attached to the uppermost portion of the illustrated structure. Specific chair seat or floor engaging members have been purposely omitted for purposes of clarity since any desirable type of such structure may be employed in combination with the height adjusting mechanism of the present invention.

It will be understood that in each of the fragmentary illustrations of FIGS. 1–4, the ilustrated structure is substantially duplicated about the vertical center line of the figures. All components as contained in these figures are identical with the distinction between each of these four figures being the variation in the degree of vertical adjustment of the screw post and the distinction between both such adjustments when the weight of a user of the chair is present or is not present.

The adjusting mechanism components are substantially entirely contained within the confines of the cylindrical base or support column generally designated 1. Centrally disposed within the column 1 is the screw post generally designated 2, and which includes a pair of spaced apart knurled portions 3—3 at its upper end while the remainder of the screw post 2 will be seen to be threaded as at 4. The only element permanently affixed to the screw post 2 is the upper bearing 5, constructed of steel, and which is pressfitted onto the upper portion of the post 2 and retained rigidly attached thereto by means of the aforementioned knurled portions 3—3. The bottom 6 of the upper bearing 5 is contiguous to the bottom of the lowermost knurl 3 while the top 7 of the screw post 2 is located well below the top 8 of the upper bearing 5 to provide a cavity 9 of substantial depth within the bore 10 of the upper bearing 5. An appropriate spindle or other suitable structure C depending from the bottom of a chair seat may be mounted within the upper bearing cavity 9 and in cooperation with the top 8 of the bearing 5 to thus provide support for the entire upper structure of any suitable swivel or pivotal chair.

Figure 6:
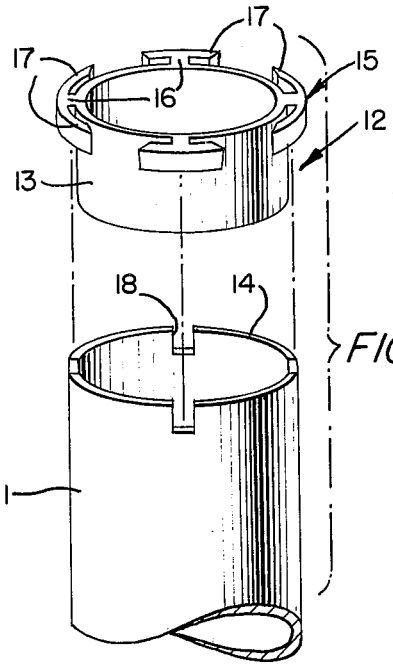
FIG. 6 is a fragmentary perspective view illustrating the relationship of the cap retainer and fixed bearing in the upper portion of the base column.

As will be more readily appreciated during subsequent description, the upper bearing 5 together with its attached screw post 2 undergoes a constant vertical displacement along with arcuate displacement relative the base column 1 during both pivotal displacement and vertical adjustment of the chair seat and accordingly, to protect the periphery 11 of the upper bearing 5, a cap retainer and fixed upper column bearing 12 having a depending cylindrical sleeve 13 is inserted into the interior of the column 1 adjacent its top edge 14. In this manner it will follow that the periphery 11 of the shiftable bearing 5 will be smoothly supported and adequately protected from contact with the top edge 14 of the column 1. As shown in FIG. 6, the upper column bearing 12 includes a plurality of attaching elements 15, each including a radially extending web 16 from which arcuately extend a pair of curved arms 17—17. Cooperating with the attaching elements 15 in order to retain the upper column bearing 12 in its use position are a plurality of notches 18 formed in the top edge 14 of the column 1. In this manner it will be seen that means are provided to preclude the entrance of dirt or other foreign material into the interior of the base column 1, while at the same time substantial bearing support means are provided at the high stress point between the base column 1 and the movable components contained therein and, additionally, it will be appreciated that should the need arise to replace the upper bearing 12 this is a very simple operation which may be achieved without the need for any tools or the disassembly of any other components of the invention. Additionally, the element 12 serves as an assembly retainer as it caps the top end of the column 1 and as will be appreciated hereinafter, allows for ready disassembly of the entire plurality of adjusting mechanism components.

Figure 5:
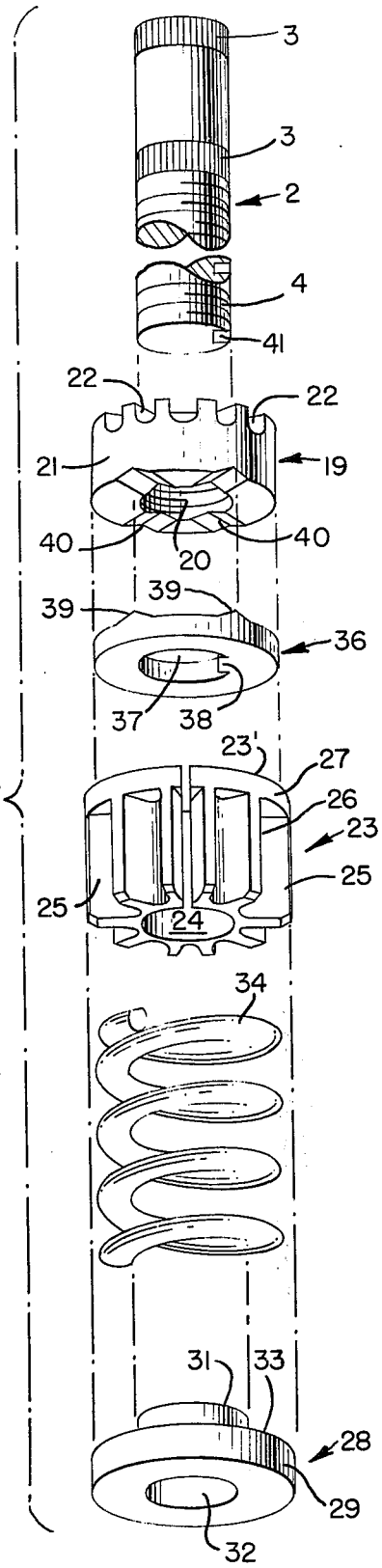
FIG. 5 is an exploded perspective view illustrating the principal components as contained within the base column of the height adjusting mechanism of the present invention.

The only element captively engaging the threaded peripheral portion 4 of the screw post 3 is the adjustment nut, generally designated 19, which is shown most clearly in detail in the exploded view of FIG. 5. This nut is provided with a central axial bore having internal threads 20 which at all times engage with the threaded portion 4 of the screw post 2. The outer periphery 21 of the nut 19 is well spaced inwardly from the body of the base column 1 as shown in FIGS. 1–4 to preclude any inteference therewith during chair use or manipulation of the height adjustment mechanism of the invention. The top portion of the adjustment nut 19 is provided with catch means comprising a plurality of closely spaced and radially extending notches 22. It is not necessary that the notches 22 extend inwardly through the internal threads 20, but it is important that these notches do extend outwardly through the adjustment nut periphery 21 for reasons which will become apparent hereinafter.

Disposed within the base column 1 below the adjustment nut 19 is a lower shiftable bearing generally designated 23 which also is preferably constructed of plastic composition and includes a planar top plate 23′ (FIG. 5), a depending central bore 24 and a plurality of radially extending, closely spaced vertical flutes 25, the outer peripheral surfaces 26 of which are vertically co-planar with the peripheral surface 27 of the top plate 23′. The bore 24 of the lower shiftable bearing 23 is sized to provide a close sliding fit with the crest of the threads 4 of the screw post 2 while the vertical flutes 25 thereof radially extend outwardly a sufficient distance along with the surface 27 to provide a close sliding fit with the interior of the base column 1 such that positive bearing suppot is at all times provided to the lower portion of the screw post 2 in order to obviate any wobbling action between the screw post 2 and base column 1. Thus, it will be observed, the upper shiftable bearing 5 and lower shiftable bearing 23 at opposite ends of the post 2 are both vertically shiftable relative the column 1 to provice stabilizing support throughout the range of adjustment of the post 2.

Adjacent the lower end of the base column 1 is a lower column spacer bearing and abutment, generally designated 28, comprising a circular collar 29 which is permanently affixed to the interior of the base column 1 by any suitable means such as the weld 30. A central sleeve 31 extends upwardly from the interior of the collar 29 and provides a vertical bore 32 having an internal diameter which is slightly greater than the diameter of the threaded portion 4 of the screw post 2. The upper portion of the collar 29 will be seen to form a shoulder 33 adjacent the outer periphery of the upstanding sleeve 31 and this shoulder serves as a stationary abutment of the lowermost convolution of the compression spring 34. The uppermost convolution of the spring 34 at all times bears against the bottom surface 35 of the lower shiftable bearing 23 and the entire length of the spring 34 is preferably coated with a suitable resilient composition such as plastic, not only to preclude corrosion of the spring but also to assure quietness of operation as the spring is repeatedly compressed and expanded during operation of the present invention.

Disposed intermediate the top plate 23′ of the lower shiftable bearing 23 and the bottom of the adjustment nut 19 is a lock ring generally designated 36. As shown most clearly in FIG. 5 of the drawings, the lock ring includes a cylindrical element having a central bore 37 provided with an inwardly directed tab 38 and the lower surface of the lock ring will be seen to be planar while the upper surface is provided with a plurality of ridges 39, similar in number to the number of valleys 40 formed in the bottom surface of the adjustment nut 19. Preferably, the radius of the ridges 39 is greater than the radius of the valleys 40 in order to decentralize the point of contact between these opposed elements. The lock ring 36 revolves at all times as a unit with the screw post 2 due to the provision of its tab 38 which will be seen to be disposed within the key-way 41 vertically extending throughout the threaded portion 4 of the screw post.

The function of a lock ring as disclosed herein is well known to those skilled in this art. Since the lock ring is arcuately fixed relative the screw post it will follow that if the adjustment nut 19 is not held captive against arcuate displacement, then upon rotation of the screw post there will be assurance that the nut will similarly rotate with the screw post due to the limited engagement between the ridges 39 and valleys 40 without there being any relative movement between the threads of the adjustment nut and the threaded portion 4 of the screw post 2. Without the use of such a lock ring 36 it would follow that the friction between the top plate 23' of the lower shiftable bearing 23 and the bottom of the adjustment 19 would be sufficient to partially resist the arcuate displacement of the unretarded adjustment nut during rotation of the screw post 2, thus permitting relative motion between the cooperating threads of the screw post and adjustment nut whereupon the chair height would be altered unintentionally.

Figure 1:
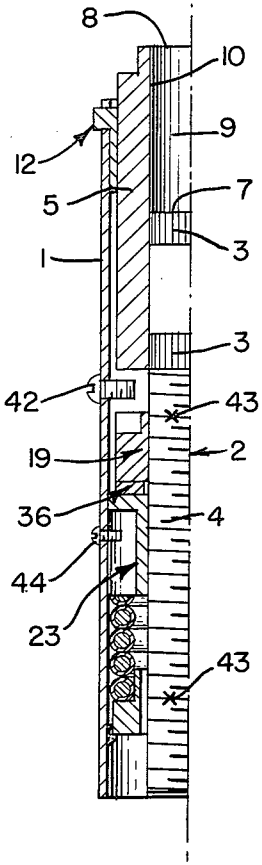
FIG. 1 is a fragmentary vertical sectional view of the chair height adjustment mechanism according to the present invention as it appears when adjusted to a low position and the chair is occupied or an outside mass is disposed thereupon.

With the basic components contained in the base column 1 having been described, the specific relationship therebetween and the operation thereof will now be related with initial reference being made to FIG. 1 of the drawings. In this figure the components appear as they would when the elements have been adjusted to produce the lowest possible height for the chair set and an outside mass such as a user, is seated in the chair with his full weight upon the illustrated mechanism. At this point the occupant'weight upon the upper shiftable bearing 5 and its attached screw post 2 urges the screw post and its engaged adjustment nut 19 downwardly along with the lower shiftable bearing 23 until the compression spring 34 is completely compressed as shown in FIG. 1 of the drawing. It will be observed that if the chair occupant were to swivel the seat structure C, upper bearing 5 and screw post 2, there would be no change in the relative displacement between the screw post and adjustment nut inasmuch as the lock ring 36, by means of its tab 38 connecting the ring to the screw post and by means of its ridges 39 which are disposed within the valleys 40 of the adjustment nut, ensures that the adjustment nut will rotate in a like manner or as a unit with the screw post 2.

Figure 2:
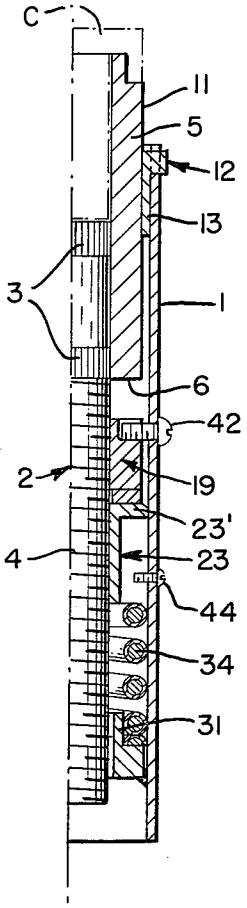
FIG. 2 is a fragmentary vertical sectional view of the structure as shown in FIG. 1 when the chair is unoccupied.

However, when the occupant no longer is seated upon the chair the mechanism as illustrated in FIG. 1 will change to the relationship as shown in FIG. 2 wherein it will be seen that the compression spring 34, bearing on the one hand against the abutment 33 of the fixed lower column spacer bearing 28 and on the other hand against the movable lower shiftable bearing 23, has urged the lower bearing 23 upwardly within the base column 1, thereby urging in turn the adjustment nut 19 and its captive screw post 2. The limit of this vertical movement is regulated by means of stationary lock means carried by the base column 1 and projecting interiorly thereof above the adjustment nut 19. This lock means preferably comprises the lock pin 42, the dimensions of which ensure a non-interference or mating fit within any one of the notches or catch means 22 formed on the upper portion of the adjustment nut 19. This lock pin 42 not only restricts the vertical displacement of the lock nut 19, but more importantly immobilizes the adjustment nut against any arcuate displacement relative the base column 1 such that subsequent arcuate displacement of the screw post 2 and upper shiftable bearing 5 results in the threaded portion 4 of the screw post being elevated or lowered with respect to the threads 20 of the adjustment nut 19 and the column 1, thereby producing a raising or lowering of the chair seat height.

Quite obviously, means must be provided to restrict or limit the extent of the relative vertical displacement between the screw post 2 and adjustment nut 19 so that the upper shiftable bearing 5 will not be lowered into abutment with the lock pin 42 on the one hand so that the screw post 2 will not be elevated to such an extent as to completely remove it from the adjustment nut 19. This limiting means may comprise a simple stake 43 in the threaded portion 4 of the screw post 2 at one point spaced downwardly from the lowermost knurl 3 and at another point spaced upwardly from the lowermost portion of the screw post 2. It also follows that the effective operating height of the spring 34 is selected to ensure the above described elevation resulting in engagement between the catch means 22 and lock means 42 whenever the chair set is unoccupied.

The bearing support capability of the lower shiftable bearing 23 is enhanced if means are provided to preclude arcuate displacement of this bearing relative the interior of the base column 1. Accordingly, a retainer pin 44 extends through the base column 1 into the interior thereof and projects between a pair of the vertical flutes 25 of the lower shiftable bearing 23 without interference therewith so that this bearing is free to move verticaly, yet restrained from arcuate movement. Quite obviously the height of this fixed retainer pin 44 is selected to ensure that it will at all times be disposed between a pair of the flutes 25 and will not abut the top plate 23' when the chair seat is either unoccupied or occupied.

Ready disassembly of the foregoing described components may be achieved without the need for special tools. Initially, the cap retainer and fixed upper column bearing is lifted out and then, if the stationary lock pin 42 is a screw as illustrated in the drawings, this may be easily removed to allow withdrawal of the upper shiftable bearing 5, screw post 2 and nut 19 as a unit. If the lock ring 36 and lower shiftable bearing 23 remained behind these may be readily lifted out. To remove the compression spring 34, the last movable component, it may be necessary to remove the pin 44 which, if in the form of a screw such as the lock pin 42, may be easily removed.

We claim:

1. Height adjusting mechanism for a chair seat including, a base column, a screw post having a threaded periphery disposed within said base column, bearing means radially supporting said post within said column, an adjustment nut within said column having internal threads engaging said post threaded periphery, lock means within said column above said nut, catch means on said nut engageable with said lock means to arcuately immobilize said nut relative said column, spring means within said column applying a constant upward force upon said nut and likewise upon said post through said engaged threads, said spring means force sufficient to elevate said nut and its engaged post into abutment between said nut catch means and column lock means to limit the upward displacement of said nut when no outside mass is acting upon said post, whereby subsequent rotation of said post produces a raising or lowering of said post relative said immobilized nut and when an outside mass is acting upon said post said post and nut is lowered against the force of said spring means as said lock and catch means are disengaged whereupon subsequent rotation of said post within said bearing means does not alter the elevation of said post as said nut is arcuately displaced as a unit with said post.

2. Height adjusting mechanism for a chair seat according to claim 1 wherein, said post periphery is spaced from the interior surface of said column, and said bearing means includes an upper bearing and a lower bearing with said nut disposed intermediately thereof.

3. Height adjusting mechanism for a chair seat according to claim 1 wherein, said bearing means includes a lower bearing axially shiftable relative both said post and column and an upper non-shiftable bearing fixed to said column and said nut is disposed between said bearings.

4. Height adjusting mechanism for a chair seat according to claim 1 wherein, said bearing means includes an upper shiftable bearing fixed to the upper end of said post, an upper stationary bearing fixed to the interior of said post and engaging said upper shiftable bearing, and a lower shiftable bearing surrounding said post within said column and axially shiftable relative both said post and column.

5. Height adjusting mechanism for a chair seat according to claim 1 wherein, said bearing means includes a lower bearing within said column below said nut and axially shiftable relative said post and column, fixed abutment means adjacent the lower end of said column and said spring means comprising a compression spring having its lower portion engaging said abutment and its upper portion engaging said lower bearing.

6. Height adjusting mechanism for a chair seat according to claim 1 wherein, said catch means includes a plurality of radial notches extending through the outer periphery of said nut and said lock means includes a fixed element projecting into the interior of said column.

7. Height adjusting mechanism for a chair seat according to claim 2 wherein, said upper bearing is fixedly secured to the periphery of said post and axially shiftable relative said column.

8. Height adjusting mechanism for a chair seat according to claim 5 wherein, said lower bearing includes a planar top plate and a plurality of radially extending laterally spaced flutes below said top plate, and a retainer pin fixed to said column extends interiorly of said column and between a pair of said flutes to restrict arcuate displacement of said lower axially shiftable bearing.

9. Height adjusting mechanism for a chair seat according to claim 5 including, a lock ring surrounding said post between said nut and lower shiftable bearing, said lock ring arcuately fixed and axially shiftable relative said post and cooperating friction means on the juxtaposed surfaces of said lock ring and nut.

10. Height adjusting mechanism for a chair seat according to claim 5 wherein, said spring is coated with a resilient composition.

11. Height adjusting mechanism for a chair seat according to claim 6 wherein, said fixed element is removable from the exterior of said column.

* * * * *